US009372050B2

(12) United States Patent
Franklin

(10) Patent No.: US 9,372,050 B2
(45) Date of Patent: Jun. 21, 2016

(54) MAGNETIC GUN BARREL ATTACHMENT

(71) Applicant: Colton Gill Franklin, Rayville, LA (US)

(72) Inventor: Colton Gill Franklin, Rayville, LA (US)

( * ) Notice: Subject to any disclaimer, the term of this patent is extended or adjusted under 35 U.S.C. 154(b) by 106 days.

(21) Appl. No.: 14/515,198

(22) Filed: Oct. 15, 2014

(65) Prior Publication Data

US 2015/0131269 A1 May 14, 2015

Related U.S. Application Data

(60) Provisional application No. 61/891,112, filed on Oct. 15, 2013.

(51) Int. Cl.

| | |
|---|---|
| ***F41G 1/34*** | (2006.01) |
| ***F41G 1/35*** | (2006.01) |
| ***F21V 21/096*** | (2006.01) |
| ***F21L 4/00*** | (2006.01) |
| ***F41G 11/00*** | (2006.01) |

(52) U.S. Cl.

CPC ... *F41G 1/35* (2013.01); *F21L 4/00* (2013.01); *F21V 21/0965* (2013.01); *F41G 11/001* (2013.01)

(58) Field of Classification Search

CPC ..... F41G 1/35; F41G 11/001; F21V 21/0965; F21L 4/00

USPC ..... 362/110, 111, 112, 113, 114, 190, 191

See application file for complete search history.

(56) References Cited

U.S. PATENT DOCUMENTS

| | | | | |
|---|---|---|---|---|
| 2011/0235346 | A1* | 9/2011 | Fridley | F41G 1/35 362/398 |
| 2012/0198748 | A1* | 8/2012 | Ospino Orozco | F41G 11/004 42/115 |
| 2013/0185979 | A1* | 7/2013 | Fridley | F41G 11/001 42/90 |
| 2014/0063791 | A1* | 3/2014 | Frazier | F21L 4/00 362/110 |

* cited by examiner

*Primary Examiner* — Elmito Breval
*Assistant Examiner* — Glenn Zimmerman

(57) ABSTRACT

A magnetic gun barrel attachment is provided. The magnetic gun barrel attachment includes a body. The body includes an outer surface, a front end, and a rear end. A plurality of concave channels may be formed on the outer surface from the front end to the rear end. The concave channels each include a different radius of curvature. Therefore, each concave channel may be a different size, and may thereby fit on different sized barrels of a various amount of guns. A flashlight s attached to the body. The flashlight includes a flashlight head disposed at the front end of the body. At least one magnet is disposed within the body in between the plurality of channels to attract and attach to the barrel of the gun. The magnetic gun barrel attachment may further include a tactical rail.

14 Claims, 2 Drawing Sheets

MAGNETIC GUN BARREL ATTACHMENT

CROSS-REFERENCE TO RELATED APPLICATION

This application claims the benefit of priority of U.S. provisional application No. 61/891,112, filed Oct. 15, 2013, the contents of which are herein incorporated by reference.

BACKGROUND OF THE INVENTION

The present invention relates to gun accessories and, more particularly, to a magnetic gun barrel attachment for mounting a flashlight to a gun.

Currently, tactical rails are used to mount gun accessories to guns. Gun accessories may include flashlights, laser pointers, extra handles, sites and the like. Generally, it may take a few minutes to mount an accessory to the tactical rail. Certain accessories, such as flashlights, may need to be mounted to the gun within seconds during home invasions at night. However, as mentioned above, it takes much longer to attach a flashlight to a tactical rail.

As can be seen, there is a need for an improved attachment device for gun accessories.

SUMMARY OF THE INVENTION

In one aspect of the present invention, a magnetic gun barrel attachment comprises: a body comprising an outer surface, a front end, and rear end, a plurality concave channels formed on the outer surface from the front end to the rear end, wherein each of concave channels comprise a different radius of curvature to fit around different sized barrels; a flashlight attached to the body and comprising a flashlight head disposed at the front end of the body; and at least one magnet disposed within the body in between the plurality of channels.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a flashlight that is easy and convenient to attach to any gun barrel by magnet attachment. The magnet attachment is made to accommodate gun barrels of all sizes, is relatively small and very easy to use. The rubber case and the magnet may be custom built with a three facet face design. The tube for the flashlight may be custom built to accommodate the rubber case and the magnets. The flashlight may be placed against the gun barrel and a switch may be pressed to turn on the light. The present invention allows hands free use of the flashlight hands with your firearms in a self defense or home defense situation in the dark. Also, the present invention may used during hunting.

Figure 1:
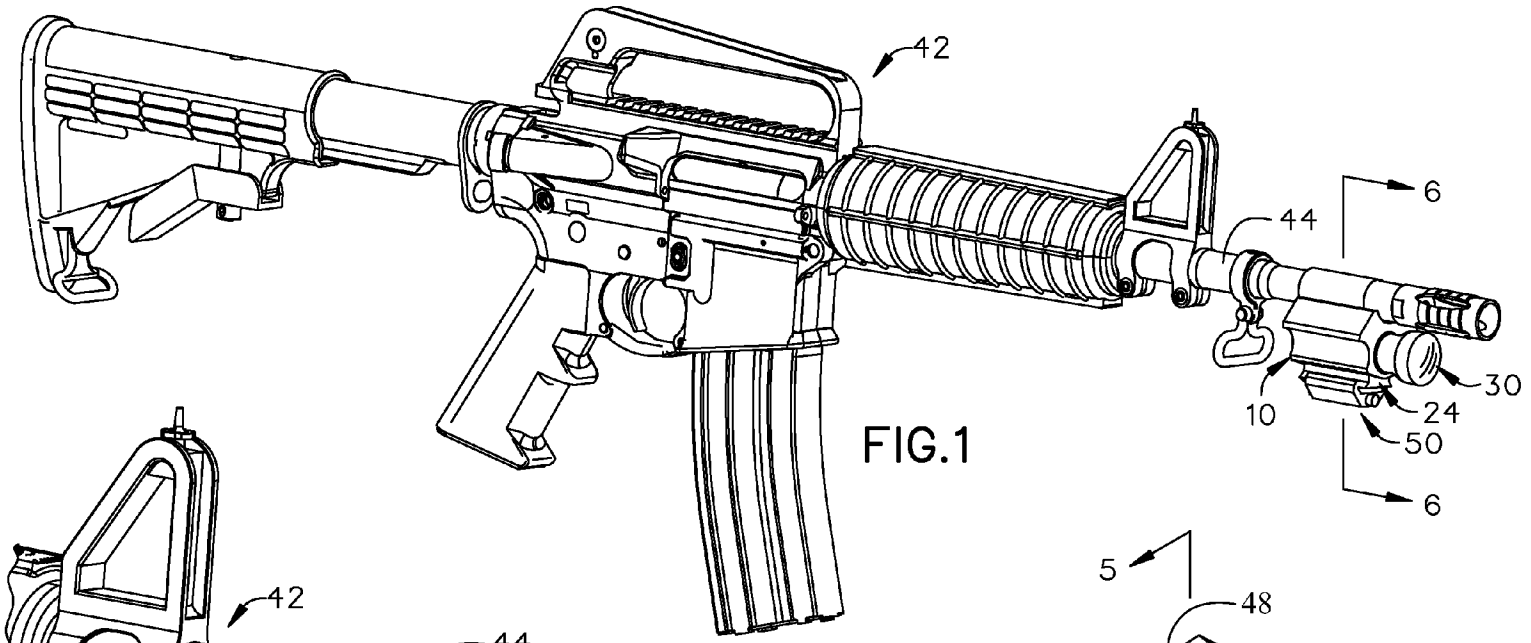
FIG. 1 is a perspective view of the present invention shown in use with an exemplary weapon.
Figure 3:
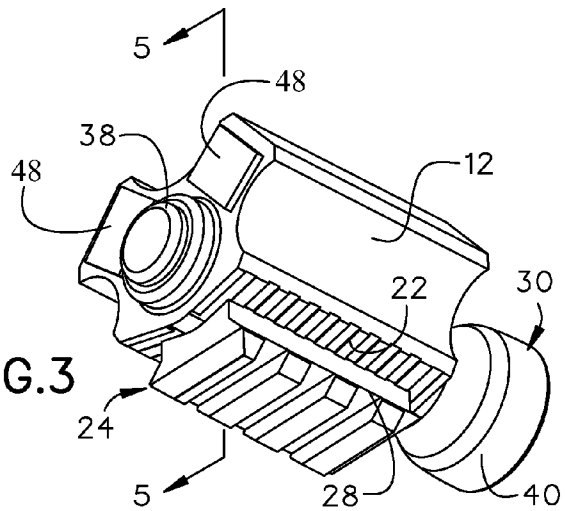
FIG. 3 is a rear perspective view of the present invention.
Figure 2:
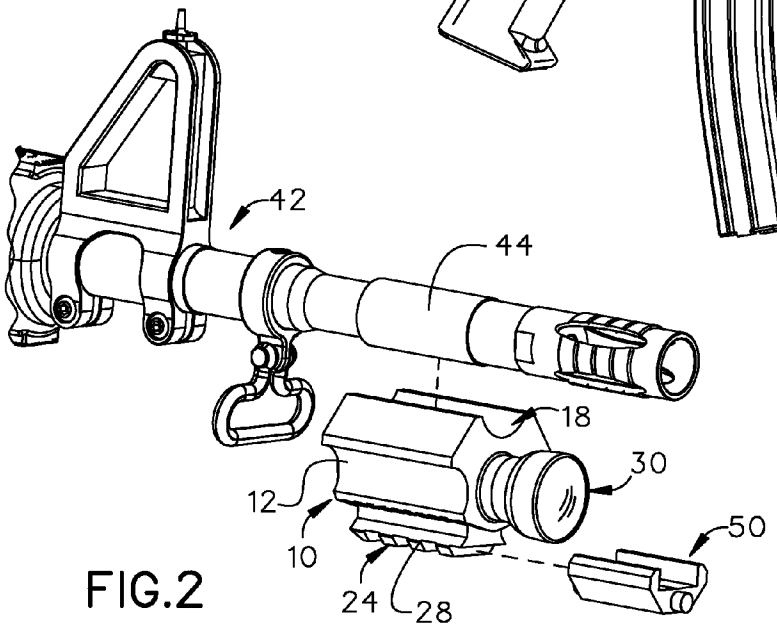
FIG. 2 is a detail exploded view of the present invention shown in use with an exemplary weapon.
Figure 4:
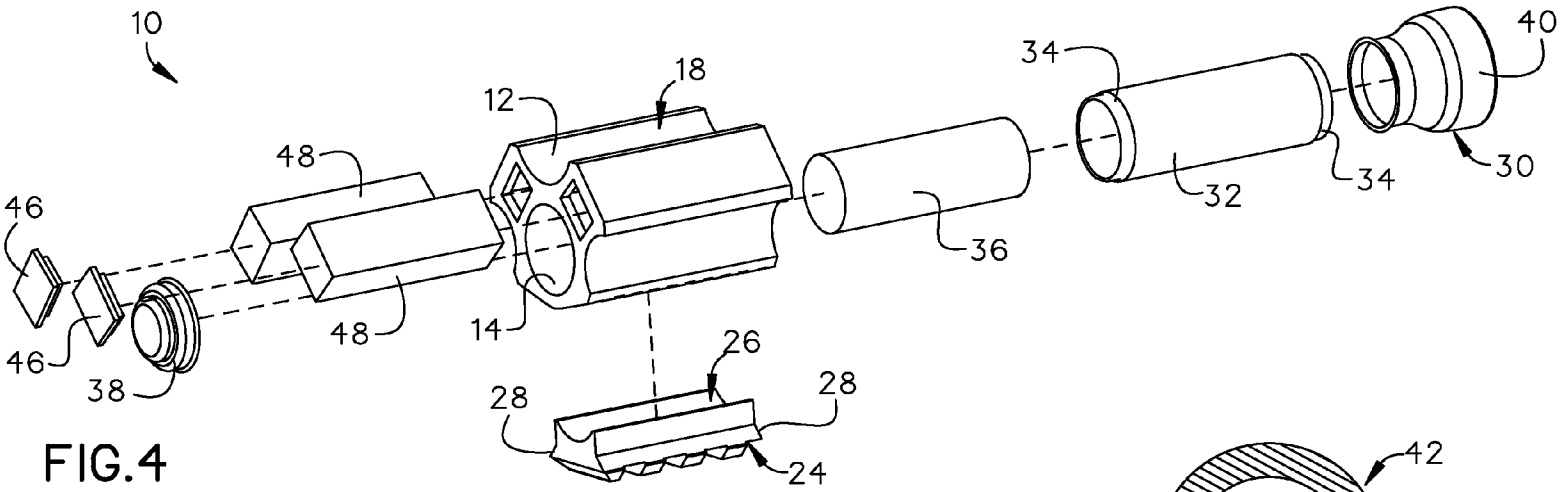
FIG. 4 is an exploded view of the present invention.
Figure 6:
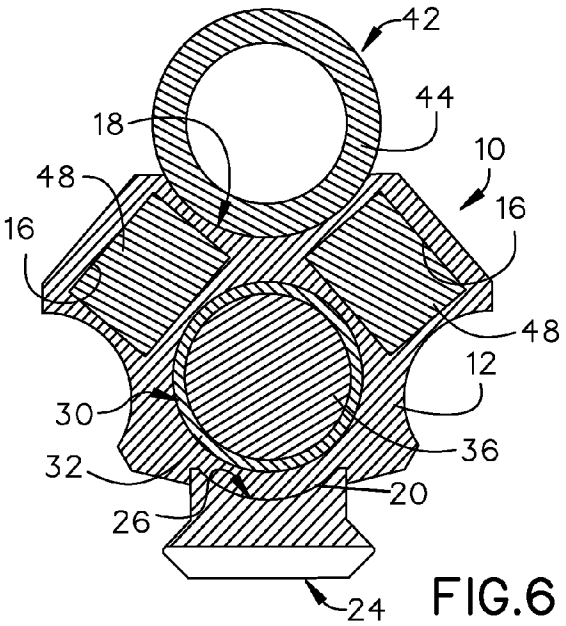
FIG. 6 is a section detail view of the present invention along line 6-6 in FIG. 1 and the optional attachment for illustrative clarity.
Figure 5:
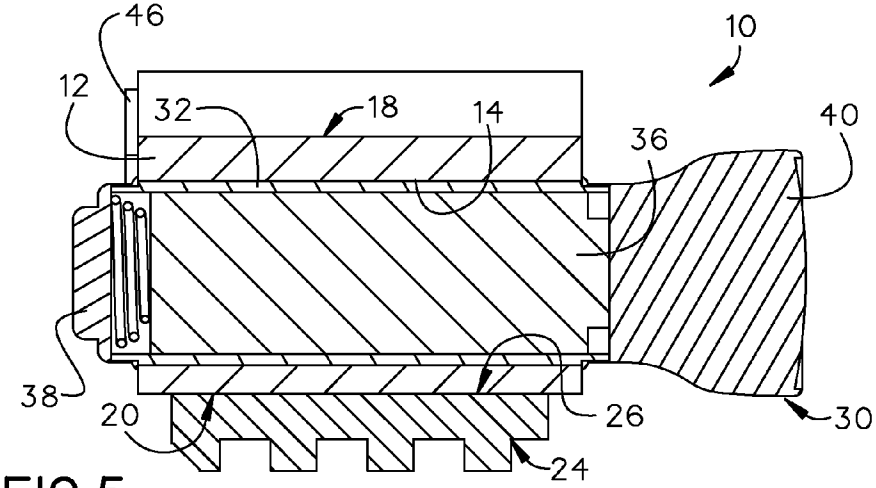
FIG. 5 is a section detail view of the present invention along line 5-5 in FIG. 3.

Referring to FIGS. 1 through 6, the present invention includes a magnetic gun barrel attachment 10. The magnetic gun barrel attachment 10 includes a body 12. The body 12 includes an outer surface, a front end, and a rear end. A plurality of concave channels 18 may be formed on the outer surface from the front end to the rear end. The channels 18 may be parallel relative to one another. The concave channels 18 each include a different radius of curvature. Therefore, each concave channel 18 may be a different size, and may thereby fit on different sized barrels 44 of a various amount of guns 42. A flashlight 30 is attached to the body 12. The flashlight 30 includes a flashlight head 40 disposed at the front end of the body 12. At least one magnet 48 is disposed within the body 12 in between the plurality of channels 18 to attract and attach to the barrel 44 of the gun 42.

In certain embodiments, the plurality of concave channels 18 may include at least a first channel 18 and a second channel 18. In certain embodiments, the present invention may include a third channel 18. A flange may protrude from the body 12 in between the first channel 18 and second channel 18, as well as in between the second channel 18 and the third channel 18. A first magnet 48 may be disposed in between the first channel 18 and second channel 18 within a first flange, and a second magnet 48 may be disposed in between the second channel 18 and the third channel 18 within a second flange. Therefore, the magnets 46 may be adjacent to the inner surfaces of the channels 18, providing maximum attraction.

The magnetic gun barrel attachment 10 may include a plurality of internal channels 14, 16 formed within the body 12. The plurality of internal channels 14, 16 may include a first magnet channel 16 sized to receive and secure the first magnet 48, a second magnet channel 16 sized to receive and secure the second magnet 48, and a flashlight channel 14 sized to receive and secure the flashlight 30.

In certain embodiments, the first magnet channel 16 and the second magnet channel 16 may include an open end and a closed end. The open end may be at the rear end of the body 12. In such embodiments, a first cap 46 may fit over the open end of the first magnet channel 16, and a second cap 46 may fit over the open end of the second magnet channel 16. Therefore, the magnets 48 may be inserted into the channels 16 on the rear end and the magnets 48 may be secured within the channels 16 using the snap on caps 46.

As mentioned above, the body 12 may include a flashlight channel 14 so that the flashlight 30 may be inserted and secured to the body 12. In certain embodiments, the flashlight 30 may include a cylindrical body 32 having a threaded front end 34 and rear end 34. A battery 36 may be secured within the cylindrical body 32. The cylindrical body 32 may be inserted into the flashlight channel 14. A flashlight cap 38 having a greater diameter than the flashlight channel 14 may be secured to the threaded rear end 34. The head 40 of the flashlight 30 may be secured to the threaded front end 34, thereby securing the flashlight 30 within the flashlight channel 14.

In certain embodiments, the present invention may further include a gun rail 24 protruding from the outer surface of the body 12. The gun rail 24 may either be integral to the body 12 or may be an attachment. The gun rail 24 may include a tactical rail portion 28. In certain embodiments, the body 12 may include a mating surface 20 formed on the outer surface. The gun rail 24 may include a magnetic gun rail mating surface 26 formed to releasably attach to the mating surface 20 of the body 12. A decorative ribbing 22 may be formed on the side of the outer surface in which the gun rail 24 is to attach. A gun rail accessory 50, such as a laser pointer, may be attached to the gun rail 24.

The body 12 of the present invention may be made of lightweight materials. For example, the body 12 may be made of a polymer, such as rubber or plastic. Therefore, the present invention may easily secure to the barrel 44 by the magnets 46. The body 26 may be made of other materials, such as light weight metals. In certain embodiments, the magnets 46 may be powerful magnets 46 and may include Neodymium.

It should be understood, of course, that the foregoing relates to exemplary embodiments of the invention and that modifications may be made without departing from the spirit and scope of the invention as set forth in the following claims.

What is claimed is:

1. A magnetic gun barrel attachment comprising:

a body comprising an outer surface, a front end, and rear end, a plurality concave channels formed on the outer surface from the front end to the rear end, wherein each of concave channels comprise a different radius of curvature to fit around different sized barrels;

a flashlight attached to the body and comprising a flashlight head disposed at the front end of the body; and at least one magnet disposed within the body in between the plurality of channels.

2. The magnetic gun barrel of claim 1, wherein the plurality of concave channels is at least a first channel and a second channel.

3. The magnetic gun barrel attachment of claim 1, further comprising a gun rail protruding from the outer surface of the body.

4. The magnetic gun barrel attachment of claim 1, wherein a magnetic mating surface is formed in the outer surface of the body.

5. The magnetic gun barrel attachment of claim 1, wherein the body is made of a polymer.

6. The magnetic gun barrel attachment of claim 1, wherein the plurality of magnets comprise Neodymium.

7. The magnetic gun barrel attachment of claim 2, wherein the plurality channels further comprises a third channel.

8. The magnetic gun barrel attachment of claim 3, further comprising a gun accessory attachable to the gun rail.

9. The magnetic gun barrel attachment of claim 5, wherein the polymer is rubber.

10. The magnetic gun barrel attachment of claim 7, wherein the at least one magnet comprises a first magnet disposed between the first channel and the second channel, and a second magnet disposed between the second channel and the third channel.

11. The magnetic gun barrel attachment of claim 10, wherein a plurality of internal channels are formed within the body, wherein the plurality of internal channels comprises a first magnet channel sized to receive and secure the first magnet, a second magnet channel sized to receive and secure the second magnet, and a flashlight channel sized to receive and secure the flashlight.

12. The magnetic gun barrel attachment of claim 11, wherein the first magnet channel and the second magnet channel comprise an open end and a closed end.

13. The magnetic gun barrel attachment of claim 12, further comprising a first cap and a second cap removably attachable to the body to cover the closed ends of the first magnet channel and the second magnet channel.

14. The magnetic gun barrel attachment of claim 13, further comprising a gun rail comprising a gun mating surface formed to releasably attach to the magnetic mating surface of the body.

* * * * *